US009186591B2

(12) United States Patent
Nielsen

(10) Patent No.: US 9,186,591 B2
(45) Date of Patent: Nov. 17, 2015

(54) TOY SPINNING TOP

(75) Inventor: Klaus Elias Nielsen, Billund (DK)

(73) Assignee: LEGO A/S, Billund (DK)

( * ) Notice: Subject to any disclaimer, the term of this patent is extended or adjusted under 35 U.S.C. 154(b) by 341 days.

(21) Appl. No.: 13/508,801

(22) PCT Filed: Nov. 10, 2010

(86) PCT No.: PCT/DK2010/050300
§ 371 (c)(1),
(2), (4) Date: Sep. 21, 2012

(87) PCT Pub. No.: WO2011/057636
PCT Pub. Date: May 19, 2011

(65) Prior Publication Data

US 2013/0012099 A1 Jan. 10, 2013

(30) Foreign Application Priority Data

Nov. 11, 2009 (DK) ..... 2009 70200

(51) Int. Cl.
*A63H 1/00* (2006.01)
*A63H 1/20* (2006.01)

(52) U.S. Cl.
CPC ..... *A63H 1/20* (2013.01)

(58) Field of Classification Search
USPC ..... 446/256–264, 128
See application file for complete search history.

(56) References Cited

U.S. PATENT DOCUMENTS

| | | | | |
|---|---|---|---|---|
| 655,621 | A | 8/1900 | Gustine | |
| 1,281,866 | A | 10/1918 | Stahl | |
| 3,236,004 | A * | 2/1966 | Christiansen | 446/128 |
| 3,798,829 | A * | 3/1974 | Worley | 446/51 |
| 4,463,518 | A * | 8/1984 | Smathers et al. | 446/435 |
| 4,538,999 | A | 9/1985 | Orlowsky | |
| 4,772,241 | A | 9/1988 | Bro et al. | |
| 5,827,106 | A * | 10/1998 | Crepeau et al. | 446/128 |
| 5,827,107 | A | 10/1998 | Bears et al. | |
| 6,746,300 | B1 * | 6/2004 | Matsukawa | 446/256 |
| 7,740,518 | B2 * | 6/2010 | Elliott | 446/256 |

FOREIGN PATENT DOCUMENTS

| | | |
|---|---|---|
| JP | 2003320174 | 11/2003 |
| WO | 03 068353 | 8/2003 |

* cited by examiner

*Primary Examiner* — Michael Dennis
*Assistant Examiner* — Urszula M Cegielnik
(74) *Attorney, Agent, or Firm* — Day Pitney LLP

(57) ABSTRACT

A toy spinning top with a displaceable platform 11 on which an object can be placed, such as a figure, and wherein the spinning top comprises means for displacing the platform 11 relative to the spinning top and at such rate that the object is ejected off the platform 11. The platform 11 is arranged to be movable in the body part by means of a forcible guide 14, 15 which, at least on a stretch of the forcible guide 14, 15, is configured such that the platform 11 can be caused to rotate only about the axis of rotation 4 relative to the spinning top simultaneously with it moving upwards or downwards along the axis of rotation 4 seen relative to the use situation in which the spinning top rotates about its essentially vertical axis of rotation 4.

9 Claims, 1 Drawing Sheet

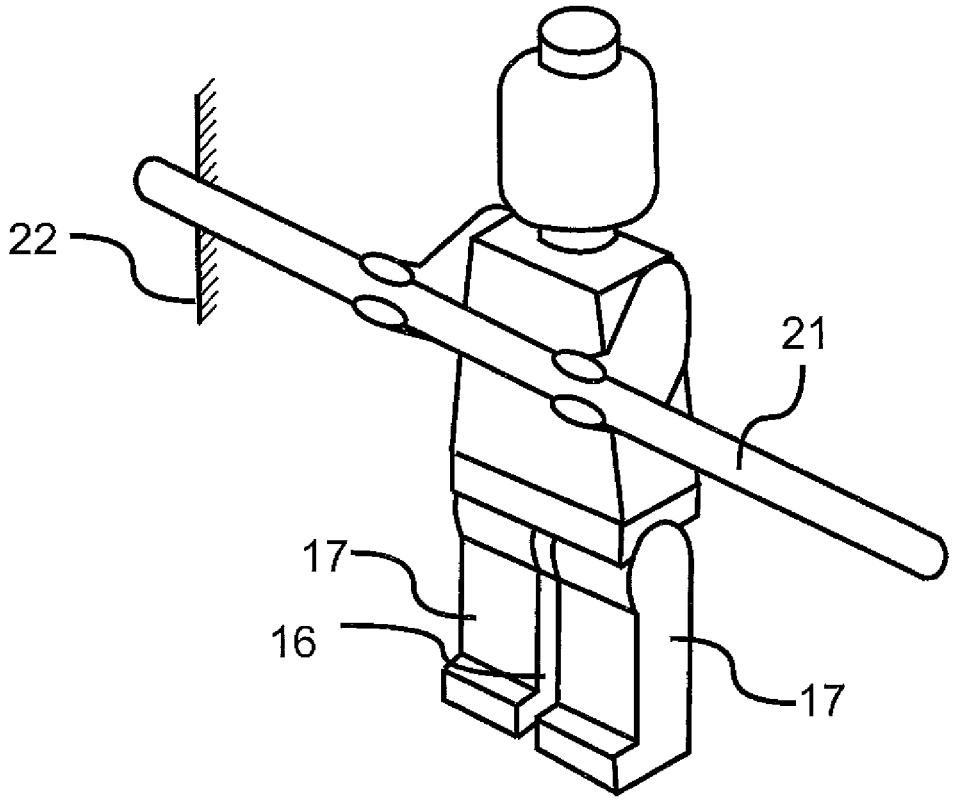
22
21
17
16
17
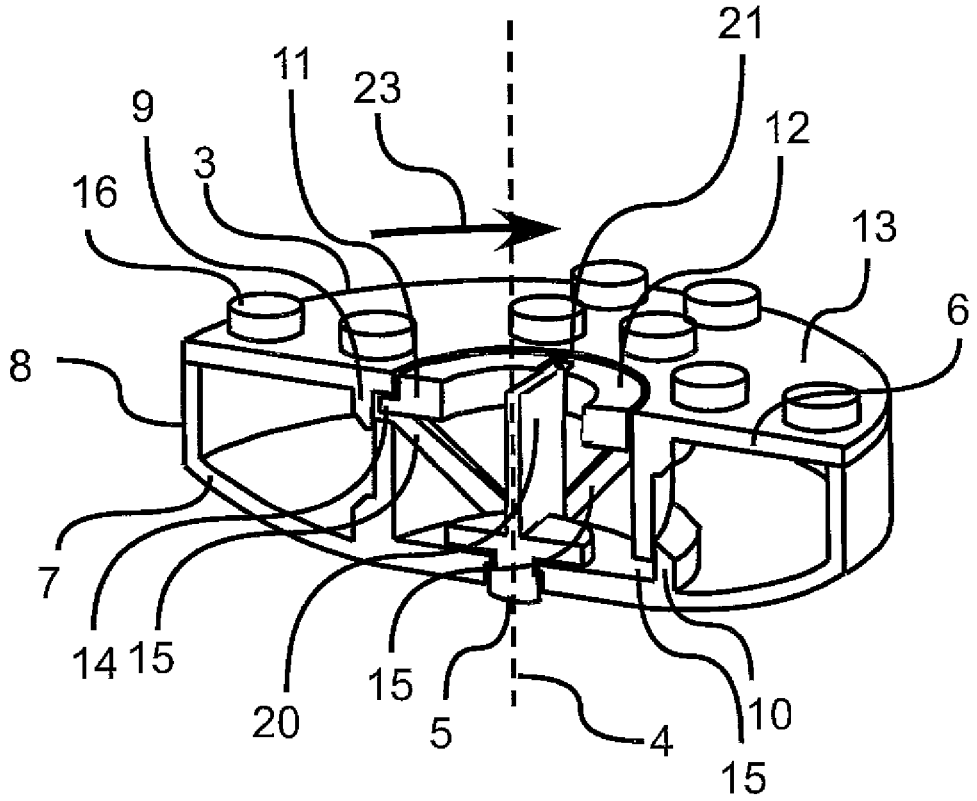
21
11
23
9
12
3
16
13
6
8
7
14
15
20
15
5
4
10
15

TOY SPINNING TOP

This application is the National Phase of PCT/DK2010/050300 filed on Nov. 10, 2010 which claims priority from Danish Patent Application No. PA200970200 filed on Nov. 11, 2009 the contents of which are incorporated herein by reference.

FIELD OF USE OF THE INVENTION

The present invention relates to a toy spinning top comprising a body part having a centre of gravity and a lowermost point which is situated essentially on a line defining an axis of rotation to the effect that the spinning top can be caused to rotate un a support about the essentially vertical axis of rotation; and wherein, in that use situation, the body part has a top face on which a displaceable platform is provided on which an object can be arranged; and wherein the spinning top comprises means for displacing the platform relative to the body part of the spinning top.

STATE OF THE ART

Today, spinning tops of the above-mentioned type exist in a number of different embodiments.

Thus, U.S. Pat. No. 1,281,866 discloses a spinning top, wherein, within the spinning top as such, a figure is concealed which is projected upwards relative to the spinning top by means of a spring when a releaser mechanism releases the spring. In that embodiment, the releaser mechanism is activated by the top on which the spinning top spins being depressed.

The same principle is known from U.S. Pat. No. 4,538,999 wherein the launcher is based upon the mechanism that, when the rate of spin of the spinning toy is reduced, the detent mechanism is activated precisely when the centrifugal force drops below a given level.

Moreover, U.S. Pat. No. 4,772,241 teaches a spinning top on which a figure is provided which is mounted on the spinning top by means of a kind of bayonet socket, which bayonet socket is configured so as to let go of its engagement when the figure is rotated relative to the spinning top as such. The figure being provided with a spring mechanism capable of ejecting the figure off the spinning top when the bayonet socket is released, the spring mechanism will result in the figure being ejected from the spinning top.

Thus, the toy spinning top according to U.S. Pat. No. 4,772,241 is suitable in particular for use in a play situation where eg two spinning tops can be caused to spin in proximity of one another, whereby the figures may collide to the effect that the bayonet socket on at least the one figure disengages from the spinning top to which it is mounted. This will result in one or both figures being ejected off the spinning top and hence some kind of competition can be performed by means of such spinning tops with two or more spinning tops as active elements.

OBJECT OF THE INVENTION

Based on this, it is the object of the present invention to provide a spinning top which is superior to the ones mentioned above for the purpose of being used in a kind of competitive game.

This is obtained in that the spinning top is as set forth above and which is characterised in that the platform is arranged movably in the body part by means of a forcible guide which is configured such as to force the platform to move upwards or downwards along the axis of rotation when it is caused to rotate about the axis of rotation relative to the body part.

Thereby a launching mechanism is provided which does not require that it is necessary to use elements in the form of springs or other elements capable of accumulating energy for launching the object placed on the platform.

According to one embodiment the forcible guide comprises at least one track which is retained relative to the body part and extends like a spiral at least a distance around and with centre in the axis of rotation, and the displaceable platform has one or more engagement pins that are secured relative to the platform and extend into the track.

The track may be configured such that it comprises at least two track stretches that are connected in extension of one another via a connecting track to the effect that the one track stretch extends from the connecting track and upwards in a spiral that runs clockwise about the axis of rotation, and the other track stretch also extends from the connecting track and upwards in a spiral that runs counter-clockwise about the axis of rotation, whereby the two track stretches and the connecting track form a coherent V-shaped track.

In this context, at least three V-shaped tracks may be provided that are arranged next to each other about the axis of rotation, and the platform may have at least three engagement pins that are arranged on the platform to the effect that each of the engagement pins engages in each their V-shaped track.

The three V-shaped tracks may further be connected to one another at their uppermost end via further connecting tracks to the effect that the three V-shaped tracks and the further connecting tracks form a round-going wave-shaped track extending about the axis of rotation.

Moreover, the toy spinning top may also comprise an object which is loose relative to the body part and which is mountable to the platform, and wherein the platform and the object are provided with mutually compatible engagement means configured such that, following mounting on the platform, the object can be displaced away from the platform essentially only in a direction along the axis of rotation.

The engagement means may be configured such that the loose object can be so arranged on the platform that the axis of rotation extends through the loose object and so that, by rotation of the loose object about the axis of rotation and via the engagement means, a corresponding rotation of the platform about the axis of rotation is provided.

Also, the body part of the toy spinning top may have an outer periphery relative to the axis of rotation, and wherein, the loose object is configured such that, following mounting on the platform, it extends a distance from the axis of rotation which is larger than the outer periphery of the body part.

Moreover, the toy spinning top may comprise a number of further loose elements, and the body part may have an essentially plane surface on which a number of coupling studs are provided for mounting of one or more of the further loose elements, the further loose elements being provided with coupling parts that are configured complementarily relative to the coupling studs on the surface of the body part.

According to one embodiment the body part and the platform are configured such that the platform can be displaced completely or partially along the axis of rotation and down below the plane surface.

LIST OF FIGURES

FIG. 1 is a perspective view of a toy spinning top with an associated figure, seen in an inclined view from above.

EMBODIMENT OF THE INVENTION

Thus, FIG. 1 shows a toy spinning top with an associated loose object being here in the shape of a human figure, but with the option of being, in principle, of any other shape with due regard to the game for which the toy spinning top 1 is intended for use.

The toy spinning top is shown as a sectional view along the axis of rotation 4, and the not shown part of the toy spinning top 3 is mirror-symmetrical about the section face relative to the shown part.

The toy spinning top 1 has a body part 3 which, in the shown embodiment, is configured with a certain symmetry about the axis of rotation 4, and is overall configured such that, when the toy spinning top 1 is caused to rotate at a certain speed about the axis of rotation 4, both the lowermost point 5 on the underside of the body part 3 and the centre of gravity of the toy spinning top 1 will be located at or very close to the axis of rotation 4.

The body part 3 as such comprises an upper part 6 and a lower part 7 which are joined by gluing at the outer periphery 8 of the body part 3 and at overlapping flanges 9 and 10 placed centrally within the body part 3. Thereby the upper part 6 and the lower part 7 constitute a considerable bulk which, when rotating about the axis of rotation 4, provides a certain moment of inertia. Moreover, the upper part 6 has an essentially plane surface 13 on which a number of coupling studs 16 are provided on which one may mount eg a building element (not shown) of a known toy building set, the known building element being provided with coupling parts that are configured complementarily with the coupling studs 16. When mounting such building elements on the coupling studs 16, it is thus possible to change the centre of gravity and moment of inertia of the toy spinning top to the effect that the properties of the toy spinning top 1 can be adapted eg to various play purposes.

Centrally in the body part 3, an essentially circular platform 11 is provided whose upper face 12 is, in the shown position, approximately flush with the top face 13 of the upper part 6. The platform 11 has a number of engagement pins 14 that extend radially from the platform 11 and into a track 15 extending at a fixed distance and all the way around the axis of rotation 4. The track 15 further extending alternately upwards and downwards, the platform 11 will be forced to move alternately upwards and downwards if it is caused to rotate about the axis of rotation relative to the body part 3. In the shown embodiment, the platform 3 has engagement pins (only one of which is shown in the figure), and the track 15 has corresponding three upper positions or tops and three lower positions or troughs to the effect that, when the platform 14 has rotated one full rotation in the body part 3, it has forcibly moved upwards and downwards three times.

Thus, the track 15 constitutes a limitation or a forcible guide for the freedom of movement of the platform 11 relative to the body part 3, said engagement pins 14 being displaceable only along the track 15, and, based on this, it will be obvious to the person skilled in the art to configure tracks and engagement pins, respectively, in other ways than the one shown in figure without thereby departing from the idea of the present invention as set forth above. In this context it will be obvious that tracks can be configured which have another shape than the one shown in FIG. 15 and which thereby results in other movement patterns for the movement of the platform 11 in the body part 3.

As mentioned above, the figure also shows a separate object 1 in the form of a figure with two legs 17 between which there is a space 18. The legs 17 of the FIG. 1 thus constitute engagement means for mounting of the figure on the platform 11.

Correspondingly the body part 3 has a central engagement means arranged about the axis of rotation and being able to rotate about the axis of rotation 4 relative to the body part 3. The engagement means has an engagement plate 20 which, when the platform is in a position below the shown position, can be introduced into the space 18 between the legs 17 of the figure. The engagement plate 10 being, due to a forcible guide 21 configured in the platform 11, unable to rotate relative to the platform 11, it is accomplished, if the FIG. 1 is mounted on the platform 11 by introduction of the engagement plate 20 in the space 18 between the legs 17 of the figure, that the figure can be rotated about the axis of rotation 4 even if the body part 3 of the toy spinning top is retained. However, such rotation will cause the platform 11 to move forcibly up and down due to the forcible guide, and hence that the figure follows the platform up and down.

Hereby it is possible that the toy spinning top along with the associated figure mounted on the platform 11 in this lower position can be caused manually to rotate at high speed about the essentially vertical axis of rotation 4, and if the rotation of the figure is then, as shown in FIG. 1, quickly brought to a halt by the rod 21 hitting a solid structure 22, such as a wall, the body part 3 will, due to its moment of inertia and its continued rotation in the direction of the arrow 23 about the axis of rotation, cause the platform 11 with FIG. 1 mounted thereon to be quickly displaced upwards towards the uppermost position shown in FIG. 1, and thereby the FIG. 1 will be thrown off the platform 11 and the body part 3 as is shown in FIG. 1.

In accordance with the invention, a kind of catapult function is thereby established in the body part without necessitating the use of springs or the like active elements.

The invention claimed is:

1. A toy spinning top comprising a body part with a centre of gravity and a lower point situated on a line that defines an axis of rotation, to the effect that the spinning top can be caused to rotate on a support about the essentially vertical axis of rotation, and wherein the body part has, in this situation, an upper face comprising a displaceable platform on which an object can be placed, and wherein the spinning top comprises means for displacing the platform relative to the body part of the spinning top at such speed that the object is ejected off the platform, the ejection due solely to the moment of inertia of the body part upon a halting of the spinning, characterized in that the platform is arranged to be movable in the body part by means of a forcible guide which, at least on a stretch of the forcible guide, is configured such that the platform can be caused to rotate only about the axis of rotation relative to the body part simultaneously with it moving upwards or downwards along the axis of rotation, seen relative to the use situation in which the spinning top rotates about its essentially vertical axis of rotation, and wherein the forcible guide comprises at least one track which is retained relative to the body part and extends like a spiral at least a distance about and with centre in the axis of rotation, and wherein the displaceable platform has one or more engagement pins that are retained relative to the platform and extend into the track.

2. A toy spinning top according to claim 1, characterized in that the track is configured such that is comprises at least two track stretches that are connected in extension of each other via a connecting track such that the one track stretch extends from the connecting track and upwards in a spiral that runs clockwise about the axis of rotation, and the other track stretch also extends from the connecting track and upwards in a spiral running counter-clockwise about the axis of rotation, whereby the two track stretches and the connecting track form a coherent V-shaped track.

3. A toy spinning top according to claim 2, characterized in that at least three V-shaped tracks are provided that are arranged next to each other about the axis of rotation, and the platform may have at least three engagement pins that are arranged on the platform to the effect that each of the engagement pins engage in each their V-shaped track.

4. A toy spinning according to claim 3, characterized in that the three V-shaped tracks may further be connected to one another at their uppermost end via further connecting tracks to the effect that the three V-shaped tracks and the further connecting tracks form a round-going wave-shaped track extending about the axis of rotation.

5. A toy spinning top according to claim 1, characterized in that the toy spinning top also comprises an object which is loose relative to the body part and which is mountable to the platform; and wherein the platform and the object are provided with mutually compatible engagement means configured such that, following mounting on the platform, the object can be displaced away from the platform essentially in a direction along the axis of rotation.

6. A toy spinning top according to claim 5, characterized in that the engagement means are configured such that the loose object can be so arranged on the platform that the axis of rotation extends through the loose object and such that, by rotation of the loose object about the axis of rotation and via the engagement means, a corresponding rotation of the platform about the axis of rotation is provided.

7. A toy spinning top according to claim 5, characterized in that, the body part of the toy spinning top may have an outer periphery relative to the axis of rotation; and wherein the loose object is configured such that, following mounting on the platform, it extends a distance from the axis of rotation which is larger than the outer periphery of the body part.

8. A toy spinning top according to claim 1, characterized in that the spinning top comprises a number of further loose elements; and that the body part may have an essentially plane surface on which a number of coupling studs are provided for mounting of one or more of the further loose elements, the further loose elements being provided with coupling parts that are configured complementarily relative to the coupling studs on the surface of the body part.

9. A toy spinning top according to claim 8, characterized in that the body part and the platform are configured such that the platform can be displaced completely or partially along the axis of rotation and down below the plane surface.

* * * * *